US005183956A

United States Patent [19]

Rosenberg

[11] Patent Number: 5,183,956

[45] Date of Patent: Feb. 2, 1993

[54] PROJECTILE-LAUNCHING DEVICE

[75] Inventor: Gideon Rosenberg, Kiryat Tivon, Israel

[73] Assignee: State of Israel, Ministry of Defence Rafael-Armamend Development Authority, Haifa, Israel

[21] Appl. No.: 618,562

[22] Filed: Nov. 27, 1990

[30] Foreign Application Priority Data

Nov. 28, 1989 [IL] Israel ..... 92477

[51] Int. Cl.[5] ..... F41B 6/00

[52] U.S. Cl. ..... 89/8; 102/374; 102/376; 102/380; 124/3

[58] Field of Search ..... 89/8; 102/374, 376, 102/380; 124/3

[56] References Cited

U.S. PATENT DOCUMENTS 4,967,637 11/1990 Loffler et al. ..... 89/8
4,975,606 12/1990 Wu et al. ..... 89/8
5,012,719 5/1991 Goldstein et al. ..... 89/8

FOREIGN PATENT DOCUMENTS 244300 9/1989 Japan ..... 89/8

OTHER PUBLICATIONS

Peterson et al., "Design and Testing of High-Pressure Railguns and Projectiles", IEEE Transactions on Magnetics, vol. Mag-20, No. 2, Mar. 1984, pp. 252-255.

Thio, Y. C., "Feasibility Study of a Railgun as a Driver for Impact Fusion", DOE/ER/13048-3, Jun. 1986, pp. 6-1-6-17, 6-31-6-33.

*Primary Examiner*—Stephen C. Bentley
*Attorney, Agent, or Firm*—Benjamin J. Barish

[57] ABSTRACT

A device for accelerating a projectile to an extremely high velocity includes a launch tube having electrodes engageable with the projectile assembly for applying a large electrical voltage to it, the projectile assembly includes a pair of travelling electrodes fixed to the rear end of the projectile and engageable with the launch tube electrodes during the travel of the projectile assembly through the launch tube. The travelling electrodes define a spark gap which, under the high voltage applied from the launch tube electrodes, forms a high-temperature, high-pressure plasma arc travelling with the projectile and effective to increase its acceleration.

15 Claims, 2 Drawing Sheets

FIG 1
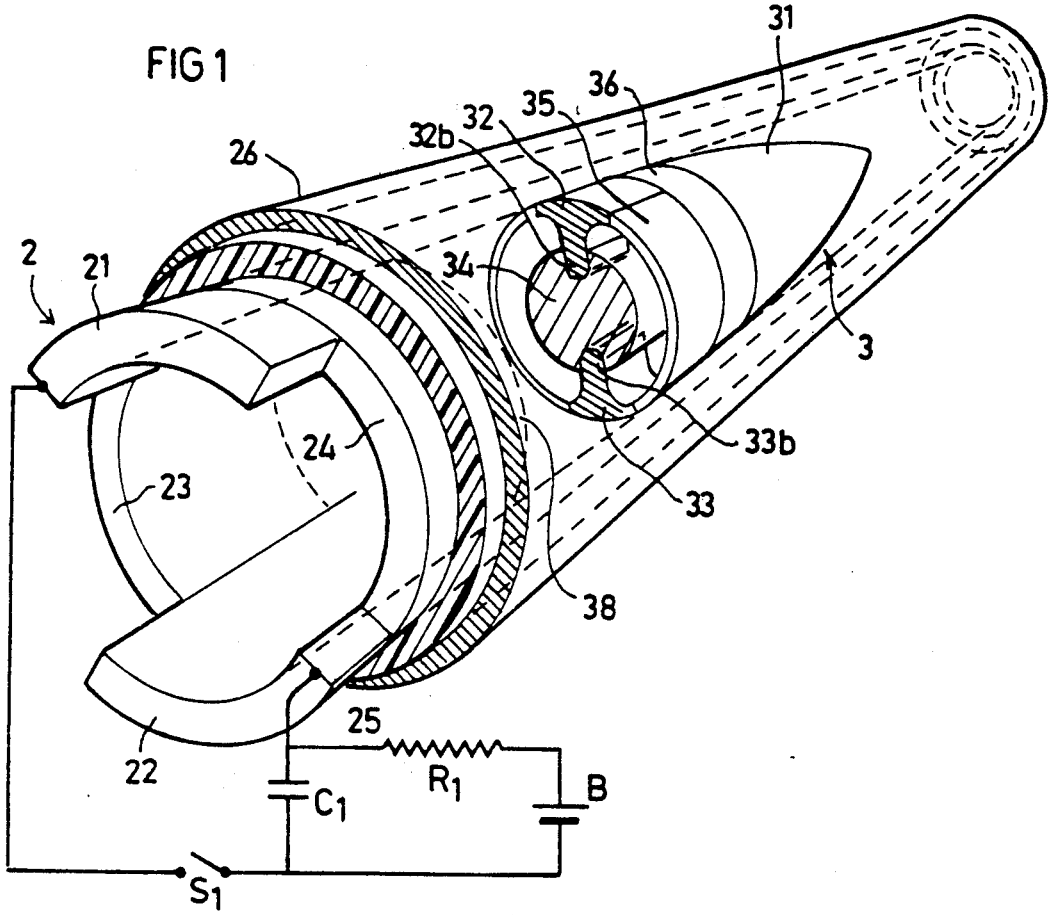
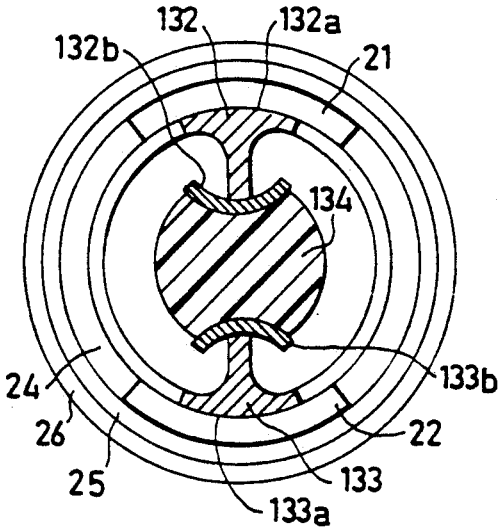
FIG 2
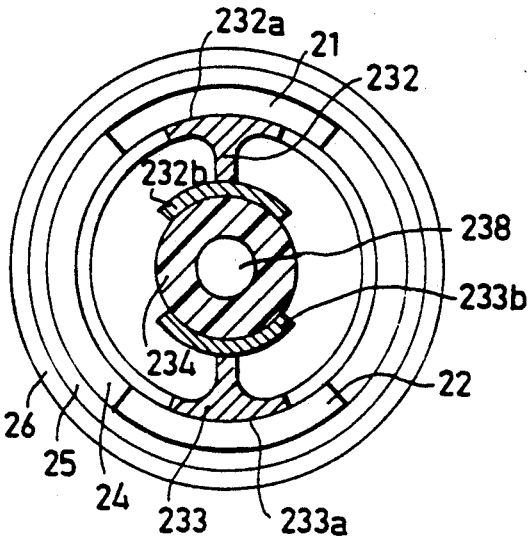
FIG 3

PROJECTILE-LAUNCHING DEVICE

FIELD AND BACKGROUND OF THE INVENTION

The present invention relates to projectile launching devices, and particularly to a device for accelerating a projectile to an extremely high velocity. The invention is particularly useful in artillery, anti-aircraft and tank guns, and is therefore described below with respect to this application.

Recent technology has been developed to replace gunpowder in artillery and tank guns by an inert material. One technique, called the electrothermal gun technique, is based on using electrical energy from a pulsed power supply to produce a high-temperature, high-pressure plasma arc to increase the acceleration of the projectile. According to this technique, the projectile assembly includes a conventional cartridge/projectile arrangement, the cartridge containing a central anode electrode and an annular body cathode with a solid dielectric charge, such as polyethylene or paraffin, between the two electrodes. The electrical energy from a pulsed power supply quickly vaporizes the dielectric charge to produce high-temperature and high-pressure gasses, which accelerate the projectile in a manner very similar to the combustion products generated from gunpowder.

While the above electrothermal gun technique has many advantages over gunpowder, it is subject to the same major limitation of gunpowder, namely that the maximum velocity to which the projectile can be accelerated is limited to the "escape velocity" of the hot gasses produced by the cartridge. Also, the acceleration efficiency decreases with increasing velocity.

Another technique recently developed to replace gunpowder is known as the "electromagnetic rail gun" technique, wherein the launch tube comprises a pair of conducting rails circumferentially separated by insulating spacers. When the launch tube is supplied with electrical energy, current flows through the rails and through an armature carried by the projectile assembly which slides between the rails, to generate a magnetic field around the rails. This magnetic field, together with the current flowing through the armature, produces a Lorentz force that accelerates the armature and the projectile with it. One form of electromagnetic rail gun is a D.C. rail gun in which the current flows in one direction through one rail and in the opposite direction through the other rail. In such a D.C. rail gun, the armature carried by the projectile is a plasma arc armature produced by a thin foil fuse that flashes into a conductive metal vapor when the high current is passed through it.

An advantage of the electromagnetic rail gun is that theoretically there is no limit as to the velocity attainable. However, the amount of electrical energy required is extremely high, much higher than that presently available in tanks for example.

Also known is a "hybrid" gun, including a first phase based on the electrothermal gun technique, and a second phase based on the electromagnetic rail gun technique. In such as hybrid gun, the first, electrothermal, phase is also limited by the "escape velocity" and its efficiency also drops with increasing velocity; whereas in the second, electromagnetic rail gun phase, considerable power is required.

OBJECTS AND BRIEF SUMMARY OF THE INVENTION

An object of the present invention is to provide a new form of device for accelerating projectiles to extremely high velocities not subject to the escape velocity limitation, having improved efficiency at higher velocities, and requiring smaller amounts of electrical energy.

According to the present invention, there is provided a device for accelerating a projectile to an extremely high velocity comprising a cylindrical launch tube, and a projectile assembly within said the launch tube. The launch tube includes launch tube electrodes engageable with the projectile assembly for applying a high electrical voltage thereto. The launch tube electrodes are spaced circumferentially of the launch tube. The projectile assembly includes the projectile to be accelerated, and a pair of travelling electrodes fixed to the rear end of the projectile and engageable with the launch tube electrodes during the travel of the projectile assembly through the launch tube. The travelling electrodes extend axially of the projectile assembly and are spaced circumferentially of the projectile assembly by insulting spacers, such as to be in sliding contact with the launch tube electrodes and to define a spark gap extending radially of the projectile assembly. The projectile assembly further includes a solid dielectric propellant in the spark gap which, under the electrical arc generated by the high voltage applied from the launch tube electrodes to the travelling electrodes, is quickly vaporized to form high-temperature, high-pressure gases travelling with the projectile and effective to increase its acceleration.

Such a construction provides advantages of both the electrothermal gun technique and the electromagnetic rail gun technique. Thus, as in the electrothermal gun technique it avoids the "gas escape velocity" limitation and theoretically permits acceleration of the projectile velocity without limitation. On the other hand, the high power requirements of the electromagnetic rail gun technique are reduced by including the solid dielectric propellant charge which is vaporized. Moreover, since the solid dielectric propellant charge is carried by the projectile itself, it becomes a travelling charge, like in a bore rocket, further boosting the acceleration of the projectile without the gas "escape velocity" limitation of the electrothermal gun technique.

Another embodiment of the invention is described below, wherein the launch tube electrodes are a pair of contact-pin electrodes located at an intermediate portion of the launch tube. In this embodiment, the means for initially accelerating the projectile assembly may be in the form of a gunpowder propellant at the rear end of the launch tube, or a light gas propellant, or a solid dielectric charge as in the electrothermal gun. In such arrangements, since the solid dielectric propellant is also carried by the projectile, it also becomes a travelling charge and permits extremely high velocities to be obtained not subject to the escape velocity limitation. The power-injection time may be extremely short, in the order of 25–50 microseconds. Thus, if the projectile is travelling at a speed of 2,000 meters/second, the travel electrodes should have a length of about ten centimeters.

Preferably, the travelling electrodes include an outer section extending axially of the projectile assembly, and an inner section extending radially at the rear end of the outer section and defining the spark gap. The outer section of the travelling electrode, particularly in the latter-described embodiment, should have a length substantially larger than that of the inner section defining the spark gap.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a general schematic illustration of one form of device constructed in accordance with the present invention for accelerating a projectile to an extremely high velocity.

FIGS. 2 and 3 schematically illustrate two modifications in the device of FIG. 1.

DESCRIPTION OF PREFERRED EMBODIMENTS

Figure 4:
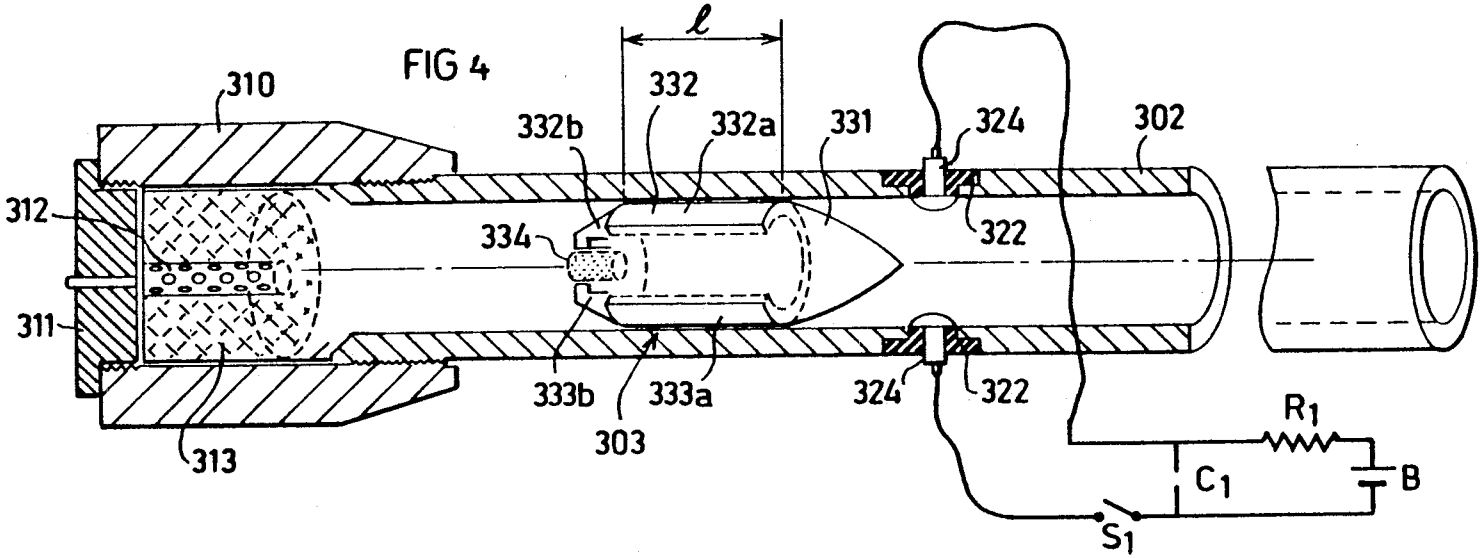
FIGS. 4 and 5 illustrate two other forms of device constructed in accordance with the present invention for accelerating a projectile to an extremely high velocity.

The device illustrated in FIG. 1 comprises a cylindrical launch tube, generally designated 2, and a projectile assembly, generally designated 3, propelled through the launch tube.

The launch tube 2 includes a pair of longitudinally-extending electrically-conductive rails 21, 22 circumferentially separated by a pair of insulating spacers 23, 24, e.g., of ceramic material. The outer surface of the launch tube 2 is shielded by an external shield 25 of insulating material, e.g., also ceramic, and is sheathed by an outer metal tube 26.

The projectile assembly 3 includes the projectile 31 at the front end of the assembly. Fixed to projectile 31, at the rear end of the assembly, are a pair of travelling electrodes 32, 33, and a solid dielectric propellant material 34 between them. The two travelling electrodes 32, 33 are joined together by a body 35 of insulating material, such as a ceramic or a composite. Body 35, the travelling electrodes 32, 33, and the solid dielectric propellant material 34, are secured to the rear face of the projectile 31 by an insulating disc 36.

The device illustrated in FIG. 1 further includes a high voltage source, such as a capacitor bank $C_1$, for applying a high voltage between the rail electrodes 21, 22, whenever switch $S_1$ is closed. The capacitor bank $C_1$ is charged by a power supply B via a resistor $R_1$.

It will thus be seen that capacitor bank $C_1$ is continuously charged to a high voltage by power supply B, so that when switch $S_1$ is closed, a high voltage is applied across the two electrically-conductive rails 21, 22. The two travelling electrodes 32, 33 carried by the projectile assembly 3 are in sliding electrical contact with the inner face of the two electrically-conductive rails 21, 22. They are provided with complementary curved surfaces of large surface area to permit a large current to flow through conductive rail 21, travelling electrode 32, the solid dielectric propellant charge 34, travelling electrode 33 and conductive rail 22. This large current quickly vaporizes the solid dielectric propellant charge 34, producing a high-temperature, high-pressure plasma arc which acts within the chamber between the closed end 38 of the launch tube 2 and the projectile assembly 3 to propel the projectile assembly forwardly at a high acceleration. The electrical current flowing through the above circuit including the two conductive rails 21, 22 and travelling electrodes 32, 33, also produces a magnetic force which provides additional acceleration to the projectile assembly 31.

Thus, after the electrothermal burning phase has been completed, the current flowing through the two conductive rails 21, 22 and travel electrodes 32, 33 provides additional electromagnetic rail acceleration to the projectile assembly. Moreover, since the solid dielectric propellant 34 is carried by the projectile assembly 3, it acts like a rocket motor so that the high pressure is continuously generated at the rear of the projectile assembly. After the solid dielectric propellant 34 has burnt out, additional acceleration is provided by the magnetic force produced by the current flowing through the conductive rails 21, 22, the travel electrodes 32, 33 and the plasma produced by the vaporized propellant charge 34.

It will thus be seen that the device illustrated in FIG. 1 is no longer subject to the "escape gas velocity" limitation of the electrothermal gun, but permits almost any velocity to be attained, depending on the current passed through the conductive rails 21, 22 and travel electrodes 33, 33 as in the conventional electromagnetic rail gun.

In the arrangement illustrated in FIG. 1, the solid dielectric propellant 34 is of generally cylindrical configuration having a length substantially equal to the length of the two travelling electrodes 32, 33. The latter two electrodes are formed with an outer convex curved surface, complementary to the inner cylindrical surface of the launch tube 2, to provide a large surface contact with the two rail electrodes 21, 22. The inner faces of the two travel electrodes 32, 33 are of reduced thickness and are received within grooves formed in the outer face of the solid dielectric propellant 34 such that the inner faces **32*b*, 33*b* of the travel electrodes produce arcs which quickly heat and vaporize the solid dielectric material. The material 34** may be one of the known dielectric plastics, such as polyethylene, or other dielectric material such as paraffin, used as dielectric fuel propellant material in the known electrothermal gun technique.

FIGS. 2 and 3 illustrate other possible shapes of the travelling electrodes and the solid dielectric propellants.

Thus, as shown in FIG. 2, the two travel electrodes 132, 133, are formed with outer convex surfaces **132*a*, 133*a*, complementary to the inner concave surfaces of the two conductive rails 21, 22, as described above to provide a large surface contact with those electrodes. The inner sides of the two travel electrodes 132*a*, 133*a*, however, are formed with large convex sections 132*b*, 133*b*, facing each other and received within concave grooves formed in the outer faces of the solid dielectric propellant 134. Electrode sections 132*b*, 133*b*** thus define spark gaps wherein the arc discharge would start on the external surface of the charge and quickly move towards its center with the burning of the charge.

FIG. 3 illustrates a construction wherein the two travel electrodes 232, 233 are also formed with convex outer faces **232*a*, 233*a* as in FIGS. 1 and 2 to provide large surface contact with the rail electrodes 21, 22; but the gas-producing sections at the inner faces of the two travel electrodes are of concave configuration, as shown at 232*b*, 233*b*, to engage large surface areas of the outer face of the cylindrical dielectric propellant 234. The construction illustrated in FIG. 3 would appear to be particularly useful when the solid dielectric propellant 234 includes a long rod penetrator, as shown at 238 in FIG. 3**.

The device illustrated in FIG. 4 also includes a launch tube, generally designated 302, and a projectile assembly 303 propelled through the tube.

In this case, however, the device includes means for initially accelerating the projectile assembly 303 through the launch tube 302. For purposes of example, the initial accelerating means is gunpowder. Thus, the breach 310 of the launch tube 302 is provided with a plug 311 containing a primer 312, and gunpowder 313 serving as the propellant when ignited by the primer. It will be appreciated, however, that the projectile assembly could be accelerated in a different manner, e.g., by a light gas propellant, or by electrothermally vaporizing a solid dielectric material as described above.

The launch tube 302 is further provided with a pair of insulating inserts 322 at an intermediate position along its length, each containing a contact-pin electrode 324 adapted to receive a large voltage pulse when engaging the projectile assembly 303 as it is propelled through the launch tube.

The projectile assembly 303 includes a projectile 331 at its front end, and a pair of travel electrodes 332, 333 circumferentially insulated from each other by insulating spacers. Each of the travel electrodes includes an outer section 332*a*, 333*a*, extending axially of the projectile assembly 303, and an inner section 332*b*, 333*b*, extending radially at the rear end of the outer section and defining a spark gap. A solid dielectric propellant 334, such as described above with respect to FIGS. 1-3, may be included in this spark gap to be quickly vaporized by high voltage, in order to form the high-temperature, high-pressure plasma arc travelling with the projectile and effective to increase its acceleration. Alternatively, the spark gap may contain a metal foil which is also quickly vaporized by the high voltage to form the high-temperature, high-pressure plasma arc.

The projectile assembly 303 is given an initial acceleration by the gunpowder propellant 313. As it is propelled through the launch tube 302, its travel electrodes 332, 333 engage the contact pin electrodes 324, carried by the launch tube. These electrodes apply a large voltage to the travel electrodes, which causes them to vaporize the solid dielectric propellant 334 to form the high-temperature, high-pressure plasma arc travelling with the projectile and effective to increase its acceleration. It will thus be seen that the described arrangement also provides a travelling charge, like a rocket, for propelling the missile, thereby enabling extremely high accelerations to be attained not subject to the escape velocity limitation.

An advantage of the FIG. 4 construction is that it enables existing launch tubes, or gun barrels, to be used, requiring only the application of the insert 322 with its contact pin electrodes 324.

The injection time for applying the electrical power via the travel electrodes, to produce the plasma arc, need only be approximately 25-50 microseconds. Assuming that the missile assembly travels at a speed of 2,000 meters/second, the outer sections 332*a*, 333*a* of the travel electrodes may have a length (l) of approximately 10 cm to provide this period of contact with the pin electrodes. The spark gap sections 332*b*, 333*b*, located at the rear end of the projectile assembly, can of course be substantially shorter.

The projectile body 331 (as well as 31 in FIG. 1) may be plated or covered with an insulating layer to prevent discharge of the high voltage through the projectile body.

Figure 5:
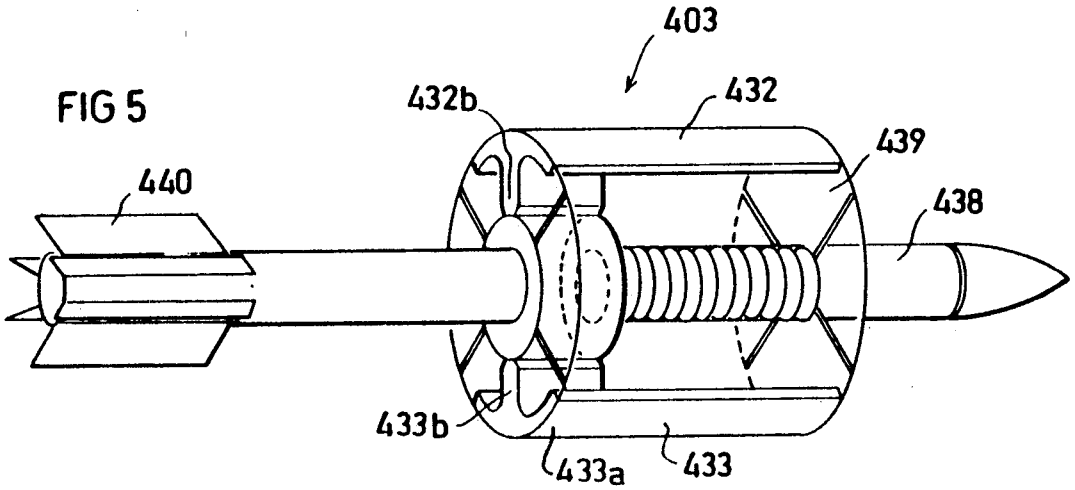

FIG. 5 illustrates a further device constructed in accordance with the present invention, wherein the projectile assembly, therein designated 403, is of a sabot structure, for example as described in U.S. Pat. No. 4,519,317. Thus it includes a pair of travel electrodes 432, 433 having outer sections 432*a*, 433*a* and inner sections 432*b*, 433*b*, as in FIG. 4. It also includes a long rod penetrator 438 carried by the sabot obturator 439 which, in this case, should be made of insulating material, such as ceramic or composite. The launch tube electrodes (not shown) could be of the conductive rail type illustrated in FIG. 1, or of the pin electrode type illustrated in FIG. 4. In either case, they form the spark gap at the rear end of the projectile assembly, which receives the high voltage applied from the conducting rails (or pin electrodes) of the launch tube to produce the high-temperature, high-pressure plasma arc travelling with the projectile and effective to increase its acceleration. In the embodiment illustrated in FIG. 5, the long rod penetrator 438 is provided with stabilizing fins 440.

While the invention has been described with respect to several preferred embodiments, it will be appreciated that many variations may be made. For example, the invention can also be embodied in a three-stage launch tube, e.g., wherein the first phase includes a conventional stationary electrothermal construction, the second phase includes a construction as described above including the travelling electrodes and the solid dielectric charge, and the third stage includes a conventional electromagnetic rail construction.

Other variations, modifications and applications of the invention will be apparent.

What is claimed is:

1. A device for accelerating a projectile to an extremely high velocity comprising:

a cylindrical launch tube, and a projectile assembly within said launch tube;

said launch tube including a pair of launch tube electrodes engageable with said projectile assembly for applying a high electrical voltage thereto;

said projectile assembly including the projectile to be accelerated, and a pair of travelling electrodes fixed to the rear end of the projectile and engageable with said a pair of launch tube electrodes during the travel of the projectile assembly through the launch tube;

said travelling electrodes being spaced circumferentially of the projectile assembly by insulating spacers, such as to be in sliding contact with said launch tube electrodes and to define a spark gap extending radially of the projectile assembly;

at least one of said pair of electrodes extending axially of said launch tube;

said projectile assembly further including a solid dielectric propellant in said spark gap which, by an electrical arc generated by the high voltage applied from said launch tube electrodes to said travelling electrodes, is quickly vaporized to form high-temperature, high-pressure gases travelling with the projectile and effective to increase its acceleration.

2. The device according to claim 1, including means for initially accelerating the projectile assembly comprising means for applying high voltage electrical energy to said launch tube electrodes when the projectile assembly is at the inner end of the launch tube.

3. The device according to claim 1, including means for initially accelerating said projectile assembly comprising a gunpowder propellant.

4. The device according to claim 1, including means for initially accelerating said projectile assembly comprising a light gas propellant.

5. The device according to claim 1, wherein said launch tube electrodes include a pair of contact-pin electrodes located at an intermediate portion of the launch tube.

6. The device according to claim 1, wherein said travelling electrodes include an outer section extending axially of the projectile assembly for engagement with the launch tube, and an inner section extending radially at the rear end of said outer section and defining said spark gap.

7. The device according to claim 6, wherein said outer section of the travelling electrodes has a length substantially larger than that of said inner section.

8. The device according to claim 1, wherein said projectile assembly further includes a long rod penetrator extending within and along the longitudinal axis of said solid dielectric propellant charge.

9. The device according to claim 1, wherein said projectile assembly is a sabot structure including a long rod penetrator extending through and along the longitudinal axis of the solid dielectric propellant charge, and a sabot obturator of insulating material forwardly of the travelling electrodes and the solid dielectric propellant charge.

10. A device for accelerating a projectile to an extremely high velocity comprising:

a launch tube, and a projectile assembly within said launch tube;

said launch tube including means for initially accelerating said projectile assembly, and launch tube electrodes including a pair of circumferentially-spaced contact-pin electrodes located at an intermediate portion of the launch tube, and engageable with said projectile assembly for applying a high electrical voltage thereto;

said projectile assembly including the projectile to be accelerated, and a pair of travelling electrodes fixed to the rear end of the projectile and engageable with said launch tube electrodes during the travel of the projectile assembly through the launch tube;

said travelling electrodes extending axially of the projectile assembly and being spaced circumferentially of the projectile assembly by insulating spacers, such as to be in sliding contact with said launch tube electrodes and to define a spark gap extending radially of the projectile assembly;

said projectile assembly further including a solid dielectric propellant in said spark gap which, by an electrical arc generated by the high voltage applied from said launch tube electrodes to said travelling electrodes, is quickly vaporized to form high-temperature, high-pressure gases travelling with the projectile and effective to increase its acceleration.

11. The device according to claim 10, wherein said means for initially accelerating said projectile assembly comprises a gunpowder propellant.

12. The device according to claim 10, wherein said means for initially accelerating said projectile assembly comprises a light gas propellant.

13. The device according to claim 10, wherein said travelling electrodes include an outer section extending axially of the projectile assembly for engagement with the launch tube, and an inner section extending radially at the rear end of said outer section and defining said spark gap.

14. The device according to claim 10, wherein said projectile assembly further includes a long rod penetrator extending within and along the longitudinal axis of said solid dielectric propellant charge.

15. The device according to claim 10, wherein said projectile assembly is a sabot structure including a long rod penetrator extending through and along the longitudinal axis of the solid dielectric propellant charge, and a sabot obturator of insulating material forwardly of the travelling electrodes and the solid dielectric propellant charge.

* * * * *